US005085198A

United States Patent [19]

Bartlett et al.

[11] Patent Number: 5,085,198

[45] Date of Patent: Feb. 4, 1992

[54] LOW PRESSURE FUEL SUPPLY SYSTEM FOR A FUEL INJECTION PUMP

[75] Inventors: Peter J. Bartlett, Sittingbourne, Kent; Peter F. Bradford, Sudbury, Suffolk, both of United Kingdom

[73] Assignee: Lucas Industries Public Limited Company, Birmingham, United Kingdom

[21] Appl. No.: 561,700

[22] Filed: Aug. 2, 1990

[30] Foreign Application Priority Data

Aug. 4, 1989 [GB] United Kingdom ..... 8917872

[51] Int. Cl.[5] ..... F02M 31/14

[52] U.S. Cl. ..... 123/510; 123/514; 123/381; 123/557

[58] Field of Search ..... 123/510, 514, 557, 516, 123/381, 541

[56] References Cited

U.S. PATENT DOCUMENTS

| | | | |
|---|---|---|---|
| 3,630,643 | 12/1971 | Eheim et al. | 123/357 |
| 4,175,527 | 11/1979 | Sanada et al. | 123/516 |
| 4,478,197 | 10/1984 | Yasuhara et al. | 123/514 |
| 4,574,762 | 3/1986 | Mueller et al. . | |
| 4,612,897 | 9/1986 | Davis | 123/514 |
| 4,617,116 | 10/1986 | Seiler | 123/514 |

FOREIGN PATENT DOCUMENTS

| | | |
|---|---|---|
| 0145986 | 6/1985 | European Pat. Off. . |
| 2540563 | 8/1984 | France . |
| 0268940 | 11/1988 | Japan . |
| 2031994 | 4/1980 | United Kingdom . |

OTHER PUBLICATIONS

English Abstract for Japanese Patent No. 57-119157, 7/24/82, for "Device for Preventing Clogging by Wax of Engine Fuel Filter", (1 page).

Partial Translation for French Patent No. 2 540 563, p. 7, line 27 to p. 9, line 28 (2 pages).

*Primary Examiner*—E. Rollins Cross
*Assistant Examiner*—Thomas N. Moulis
*Attorney, Agent, or Firm*—Flynn, Thiel, Boutell & Tanis

[57] ABSTRACT

A low pressure fuel supply system supplies fuel which tends partially to solidify at low temperatures and whose viscosity increases with decreasing temperature, from a fuel tank along a supply line, through a filter, to a fuel injection pump. A fuel recirculating circuit for recirculating fuel warmed by the injection pump extends from a return outlet of the injection pump, along a path extending through the filter to the injection pump inlet. A permanent bleed pipe extends to the fuel tank from the portion of the recirculating circuit between the injection pump return outlet and the filter. The flow-resistance-determining dimensions of the permanent bleed pipe are such that the pipe presents increasing resistance to the flow of fuel therein with decreasing fuel temperature. It therefore carries little flow at low temperatures of the fuel therein, most of the warmed fuel from the injection pump return outlet being directed into the filter. Blockage of the filter by solidified portions of the fuel is thus avoided. Under normal operating conditions when the fuel temperature is higher, fuel flows more quickly through the permanent bleed pipe and so more of the warmed fuel is returned from the injection pump return outlet to the fuel tank, thus preventing overheating of the fuel and of the injection pump.

20 Claims, 5 Drawing Sheets

LOW PRESSURE FUEL SUPPLY SYSTEM FOR A FUEL INJECTION PUMP

BACKGROUND OF THE INVENTION

This invention relates to low pressure fuel supply systems for supplying fuel which tends partially to solidify at low ambient temperatures and whose viscosity increases with decreasing temperature, from a fuel tank to an injection pump.

Well known examples of such fuels are middle distillate fuels such as diesel fuels. When such fuels are subjected to low temperatures, their higher molecular weight hydrocarbon components tend to precipitate out of the liquid phase as wax crystals. In a fuel supply system these crystals can then after a short time block fuel filters, resulting in fuel starvation. The temperature of a fuel below which waxing occurs is termed the cloud point of the fuel, although filter blocking may only occur at temperatures substantially below the cloud point.

Diesel fuels for use in different geographical regions are tailored to alleviate the problem of waxing. It is necessary to design a fuel to provide optimum fuel viscosity at the expected operating temperature of a fuel supply system, which is affected by the ambient temperature. Fuels are therefore designed with higher content of higher molecular weight hydrocarbon components for use in hotter regions, so that adequate fuel viscosity is maintained at higher fuel supply system temperatures. Such fuels then have higher cloud points however. Lower contents of higher molecular weight hydrocarbon components are required in cooler regions to prevent excessive fuel viscosity at low temperatures and to reduce waxing. Abnormally cold ambient temperatures in any given region can still however lead to waxing if the temperature falls significantly below the cloud point of the fuel used in that region.

It is known to use thermostatically controlled valves or heaters to control diesel fuel temperatures to prevent waxing. Disadvantages arise however because fuel supply systems for use in different regions having different ambient temperatures, or in vehicles travelling from one region to another, require different thermostat settings for each region. If this is not done, since fuel viscosity at any given temperature varies according to the design of the fuel, the fuel viscosity maintained by a thermostat varies with the type of fuel used. Fuel viscosity variation then leads to reduced performance due to changes in injection pump backleak pressure causing changes in fuel supply timing and fuel delivery, and changes in the internal leakage in the pump giving variation in the volume of fuel delivered.

SUMMARY OF THE INVENTION

According to the invention there is provided a low pressure fuel supply system for supplying fuel which tends partially to solidify at low temperatures and whose viscosity increases with decreasing temperature, comprising: a fuel tank; a fuel injection pump having an inlet, a high pressure outlet and a fuel return outlet; a fuel filter; a fuel supply line extending from said tank, via said filter, to said injection pump inlet; a fuel recirculation circuit for recirculating fuel warmed by said injection pump along a path extending from said injection pump return outlet, through said filter to said injection pump inlet, and; a permanent bleed pipe extending to said fuel tank from the portion of said recirculating circuit between said injection pump return outlet and said filter, said permanent bleed pipe having flow-resistance-determining dimensions such that said pipe presents increasing resistance to the flow of fuel therein with decreasing fuel temperature so that said permanent bleed pipe carries little flow at low temperatures of the fuel therein, most of the warmed fuel from said injection pump return outlet being directed into said filter, and so that under normal operating conditions when the fuel temperature is higher, said permanent bleed pipe returns more of said warmed fuel from said injection pump return outlet to said fuel tank, thus preventing overheating of the fuel and of said injection pump.

With this arrangement, apportionment of fuel warmed by the mechanical action of the fuel injection pump between a recirculation path through the filter back to the pump, and a permanent bleed pipe to the fuel tank, is achieved by using the variation of viscosity of middle distillate fuels with temperature. Control of the viscosity and temperature of the recirculating fuel is thus achieved very simply and with no moving parts by choosing the flow determining dimensions of the permanent bleed pipe.

It is advantageous for a fuel supply system to control fuel viscosity rather than temperature, since fuel for use in a given geographical region is designed for optimum viscosity at the expected operating temperature of the fuel supply system, which varies with the expected ambient temperature. As stated above, variation of fuel viscosity either above or below the optimum viscosity leads to reduced performance, potentially causing reduced engine power at low viscosities and filter blocking or pump seizure at higher viscosities. Thermostatic control to maintain a constant fuel temperature cannot then maintain the optimum viscosity for all fuels, whereas a viscosity control system may maintain optimum viscosity even for different fuels designed for different ambient temperatures.

The permanent bleed pipe is preferably circular in section for ease of manufacture. The flow-determining dimensions of the pipe are then its internal diameter and its length. The internal diameter of at least a portion of the pipe will be substantially smaller than those of the other pipes in the fuel supply system, whose internal diameters are selected so that sufficient fuel flow is obtained even at low operating temperatures. For example if the fuel supply system of the invention is installed in a motor vehicle, the length of the permanent bleed pipe may be about 1 m and its internal diameter may be in the range 2–3 mm. The remainder of the fuel pipes and supply lines in a motor vehicle are typically of 5 to 10 mm internal diameter.

The permanent bleed pipe may however not be of constant cross section. For example, only a portion of the pipe may have a small internal diameter, while a further portion of the pipe has a larger internal diameter. The internal diameter and length of the narrow portion then largely determines the fuel flow along the whole of the permanent bleed pipe, since the narrower portion produces more resistance to fuel flow than the wider portion.

According to the invention there is further provided a low pressure fuel supply system in which fuel flows to the fuel tank from the recirculating circuit between the injection pump return outlet and the filter along a plurality of permanent bleed pipes connected in parallel with each other.

The variation with fuel temperature of the resistance to fuel flow along the permanent bleed may thus be increased if required by the use of a plurality of parallel pipes of small internal diameter. The internal diameter of any bleed pipe or portion thereof should however be large enough that the bleed pipe is not blocked at any time by the formation of wax crystals.

BRIEF DESCRIPTION OF THE DRAWINGS

Embodiments of the invention will now be described by way of example with reference to the drawings in which.

DETAILED DESCRIPTION OF THE PREFERRED EMBODIMENTS

Figure 1:
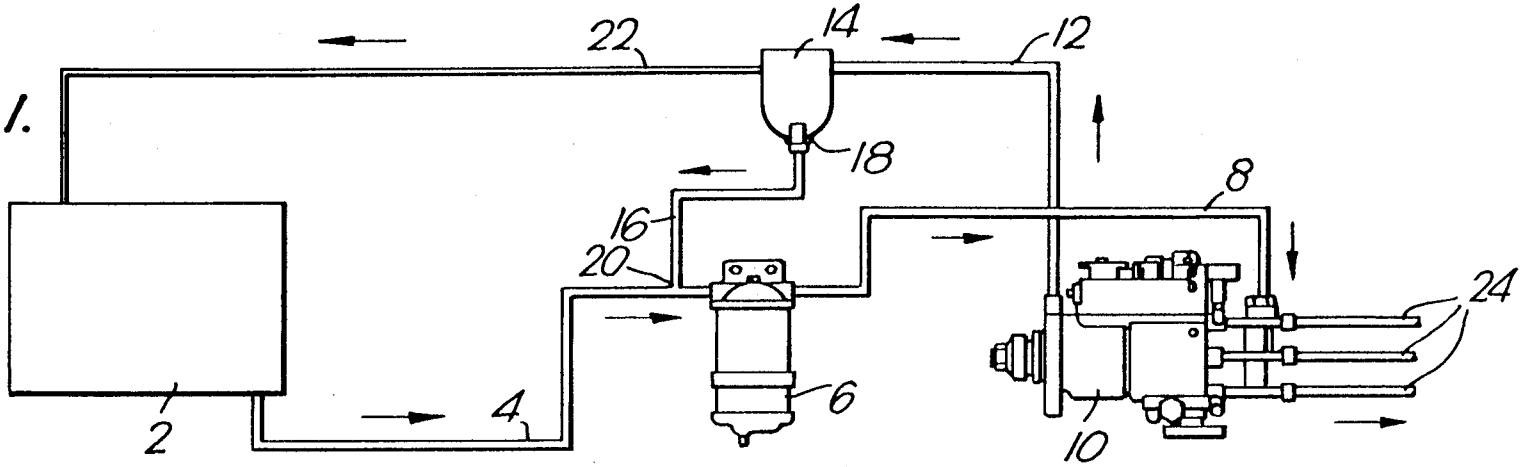
FIG. 1 is a diagram of a diesel fuel low pressure supply system including an air separator, for supplying fuel to a rotary fuel injection pump.

The system shown in FIG. 1 comprises a fuel tank 2 connected by a fuel supply line 4 to the inlet of a filter 6. The outlet of the filter 6 is connected by a further fuel supply line 8 to a rotary distributor type fuel injection pump 10. The low pressure leakage from the injection pump 10 is carried by a return line 12 to an air separator 14. A fuel recirculation path is completed by a further return line 16 carrying fuel from the air separator 14 via a non-return valve 18 to a junction 20 of the return line 16 with the first fuel supply line 4. A continuous bleed to the fuel tank 2 is provided by a small bore pipe 22 extending from the air separator 14 to the tank 2. The small bore pipe 22 also serves to vent air from the air separator 14 to the tank 2. All lines and pipes apart from the permanent bleed pipe 22 are of 5 to 10 mm diameter as in a conventional diesel fuel supply system.

In operation fuel is drawn from the tank 2 and through the filter 6 by the injection pump 10, from which pulses of fuel are delivered at high pressure along pipes 24 for fuel injection into an internal combustion engine. Some fuel leaks from the pump 10, also serving to lubricate and cool it, and enters the return line 12 at a higher pressure than that at the injection pump inlet. This returned fuel then passes into the air separator 14. Any air in the fuel rises to the top of the separator and returns to the fuel tank 2 along the bleed pipe 22.

If the fuel pressure in the air separator 14 is high enough, (the fuel in line 16 being at a low pressure), the non-return valve 18 will open and fuel will enter the further return line 16. Any such fuel will the pass through the filter 6 and recirculate to the inlet of the injection pump 10. Since the recirculated fuel has been warmed by mechanical work performed on it as it passed through the injection pump, it will tend to melt any wax crystals collected in the filter 6 and so prevent blockage.

The recirculated fuel flow will be supplemented, as required, at the junction 20 by fuel from the tank 2.

In order to open the non-return valve 18 and obtain fuel recirculation, a high enough pressure must be present in the air separator 14. The injection pump outlet pressure is sufficient for this, but the pressure within the air separator is also controlled by the pressure required for fuel flow along the permanent bleed pipe 22.

The flow-pressure-determining characteristics of the permanent bleed pipe 22, which is a circular pipe of constant cross-section, are its diameter and its length. Under conditions of streamline flow, the flow rate q, the pressure p and the absolute fuel viscosity V are related to the pipe diameter D and length 1 by the Poiseuille formula:

$$q \propto \frac{D^4 p}{Vl}$$

If the tank is mounted close to the engine, the length of the pipe 22 may be about 1 m. Its internal diameter would then be between 2 and 3 mm which is a substantially smaller diameter then pipes used conventionally. The precise internal diameter of the pipe 22 depends both on its length and on the type of fuel with which it is to be used.

At low ambient temperatures the fuel viscosity V, will be high, and so the pressure required in the separator 14 to pass all of the fuel returned from the injection pump 10 along the permanent bleed pipe 22 to the tank will be greater than that required to open the non-return valve 18. Most of the warmed fuel from the pump 10 will therefore be recirculated through the non-return valve 18 as required to warm the filter 6. Only a small proportion of the fuel will flow along the permanent bleed pipe 22.

At higher fuel temperatures, the fuel viscosity V will be low and so the fuel returned from the injection pump 10 will flow more easily along the permanent bleed pipe 22 to the tank 2. The fuel pressure in the separator 14 will be lower and so the non-return valve 18 will be opened less. A smaller flow rate of warmed fuel will then be recirculated and more of the cooler fuel from the tank will be drawn through the filter 6 into the injection pump 10, thus preventing overheating of the fuel and the pump 10.

By appropriate choice of the diameter and length of the permanent bleed pipe 22, effective control of fuel viscosity and temperature may be obtained and risk of blockage of the filter by wax reduced.

Figure 2:
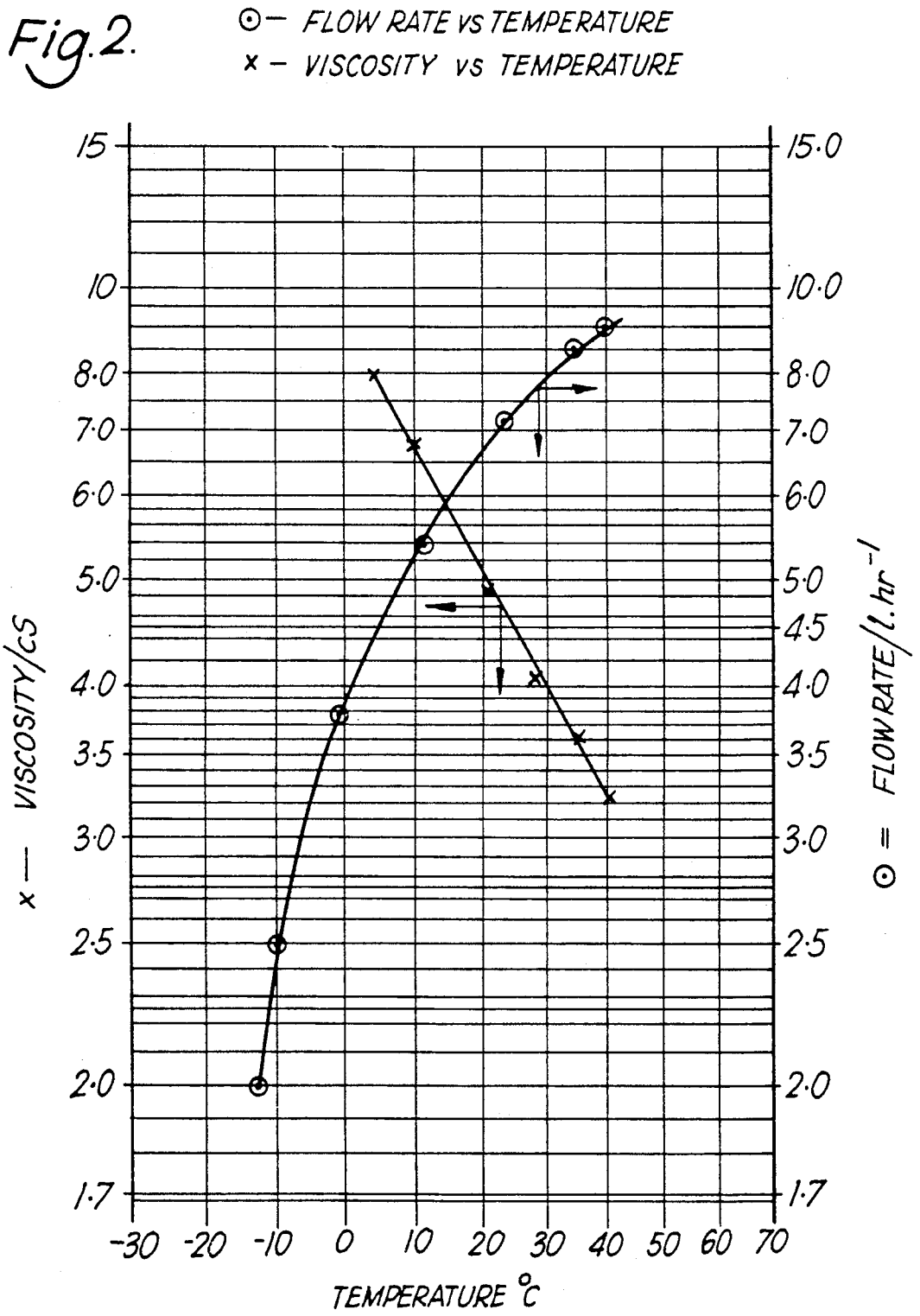
FIG. 2 is a graph of experimental data of flow rate and viscosity plotted against temperature for diesel fuel flowing through a small bore pipe.

An example of the variation of fuel flow through a pipe with fuel temperature and viscosity is illustrated in FIG. 2. This shows the results of an experimental investigation of the flow rate at a range of temperatures of Winter Grade (UK) diesel fuel from 1984, through a two meter length of 3 mm internal diameter smooth bore plastic tubing, at a constant head of 0.97 m (corresponding to 1.2 p.s.i.=8300 Pa) between the inlet and outlet of the pipe. The cloud point of the fuel is 0° C., the CFPP is −11° C. and the Pour Point is −26° C. Its specific gravity is 0.843 at 24° C. The viscosity of the fuel and its flow rate through the pipe were measured at a range of temperatures. The results are shown in tabulated form below and graphically in FIG. 2. Although these data do not demonstrate the theoretically expected proportionality of flow rate to temperature, probably due to the flow not being streamlined, a strong variation of flow rate with temperature is clearly demonstrated.

TABLE 1

| Temperature/°C. | Viscosity/Cs |
|---|---|
| −5 | 7.96 |
| 10 | 6.78 |
| 21 | 4.91 |
| 28.8 | 4.08 |
| 35.5 | 3.62 |
| 40.5 | 3.23 |

Specific Gravity .843 at 24° C.

TABLE 2

| Temperature. °C. | Flow. L/Hr |
|---|---|
| −12 | 2.0 |
| −10 | 2.5 |
| −1 | 3.8 |
| 11 | 5.4 |
| 23 | 7.2 |
| 24 | 7.3 |
| 35 | 8.6 |
| 40 | 9 |

Head: 97 cm of oil = 1.2 psi

Figure 3:
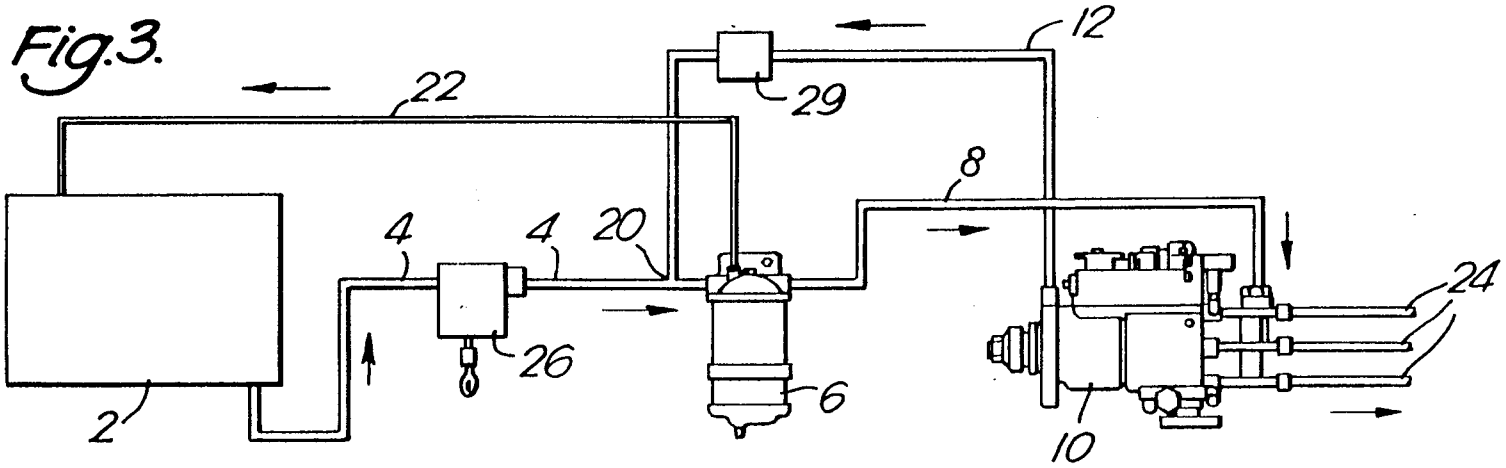
FIG. 3 is a diagram of a diesel fuel low pressure supply system including a fuel feed pump for supplying fuel to a rotary fuel injection pump.

FIG. 3 shows a fuel supply system comprising an air separation chamber in the filter unit 6, on the inlet side of the filter. The permanent bleed pipe 22 is again a small bore pipe serving both as an air bleed and to control fuel viscosity and temperature. A spring driven diaphragm fuel supply pump 24, inserted into the fuel supply line 4, provides a positive fuel pressure to the inlet side of the filter 6. This pressure is thus applied to the entrance of the small bore permanent bleed pipe 22 at the air separator chamber. The flow along this pipe is then driven by the pressure difference between the air separator chamber and the fuel tank inlet. The flow rate along the permanent bleed pipe 22 then varies substantially with fuel temperature and viscosity.

The return line 12 in FIG. 3 comprises a non-return valve 29. Since the junction 20 of the return line 12 with the fuel supply line 4 is on the outlet side of the supply pump 26, the non-return valve 29 is required to prevent the flow of fuel along the return line 12 into the cambox of the injection pump 10 when the supply pump 26 is operated to prime the injection pump prior to starting.

The embodiment of FIG. 3 may be modified so that junction 20 of the return line 12 with the supply line 4 is on the inlet side of the supply pump 26. The non-return valve 29 in the return line 12 is then not required.

Figure 4:
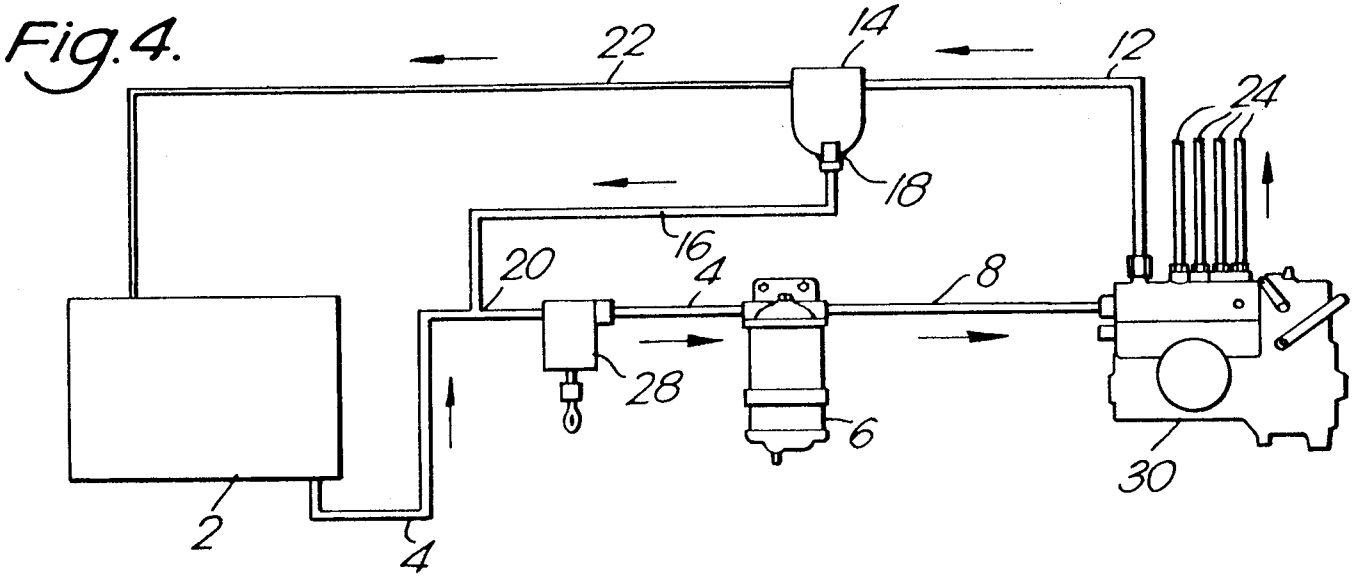
FIG. 4 is a diagram of a diesel fuel low pressure supply system including an air separator and a fuel feed pump for supplying an in-line fuel injection pump.

The low pressure supply system shown in FIG. 4 is as in FIG. 1 except that a fuel supply pump 28 is inserted in the fuel supply line 4 between its junction 20 with the return line 16 and the filter inlet. The supply pump 28 is thus included in the fuel recirculation circuit.

The injection pump 30 in FIG. 4 is of the in-line type, in which there is not normally an internal transfer pump. The fuel pressure at the return line is therefore low. The junction 20 of the return line 12 with the supply line 4 must therefore be on the inlet side of the feed pump 28 as the fuel pressure in the return line 12 will be lower than that at the filter inlet.

Figure 7:
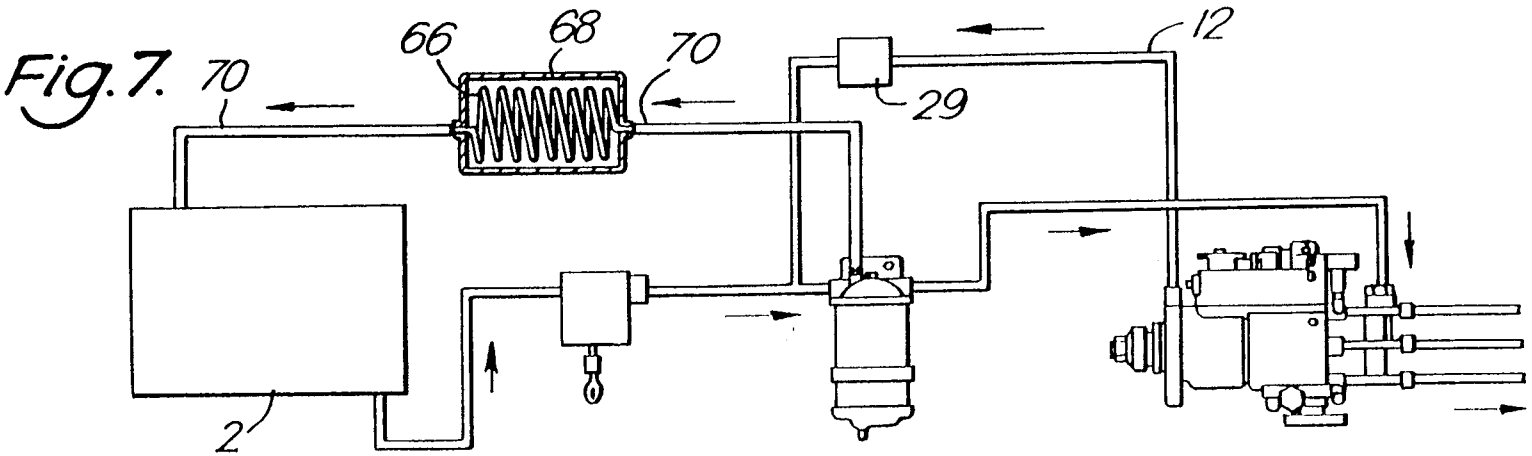
FIG. 7 is a diagram of a diesel fuel low pressure supply system including a small-bore pipe contained in a housing and connected into the return line of the fuel system.
Figure 5:
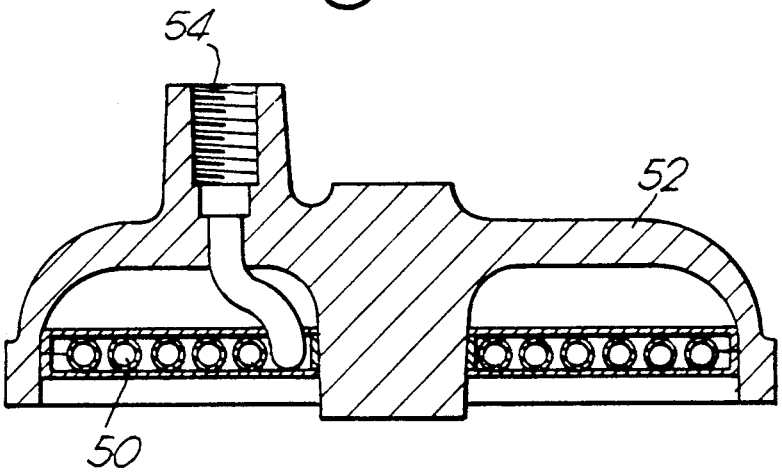
FIG. 5 is a cross-section of a filter head having a small bore pipe coiled within it.
Figure 6:
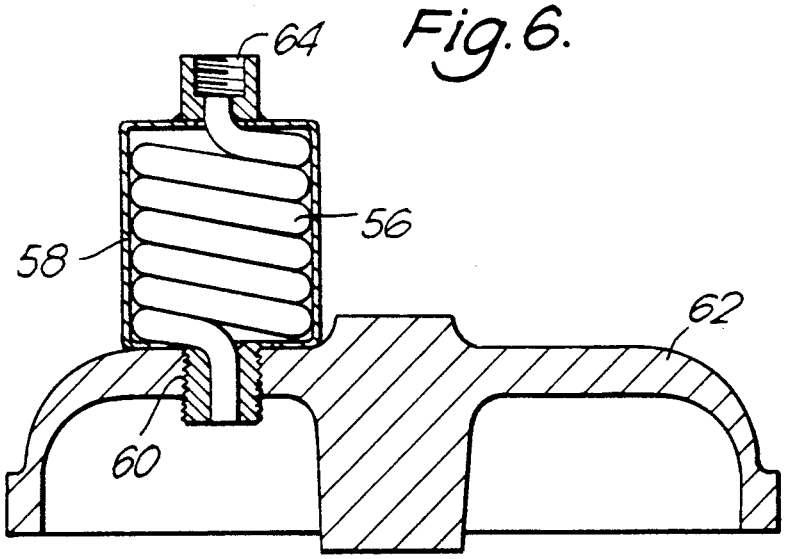
FIG. 6 is a cross-section of a filter head and a housing fastened thereto, the housing containing a small-bore pipe.

FIGS. 1, 3 and 4 show diagrammatically the layout of three embodiments of the low pressure fuel supply system of the invention. In practice the small bore permanent bleed pipe may be packaged more conveniently for installation for example in a vehicle. FIGS. 5 to 7 show examples of such packaging.

In FIG. 5, a length of small bore tube is located as a coil 50 in the head 52 of a fuel filter. This could be used in the embodiment of FIG. 3 in which the small bore pipe 22 forms a permanent bleed from the head of the filter 6 to the tank. In this embodiment the filter head also provides an air separator. If, as in FIG. 5, the small bore pipe forms a coil 50 in the filter head 52, the outlet 54 from the filter head can be a bleed pipe of conventional, larger diameter, thus making installation of the system more convenient.

FIG. 6 shows the small bore pipe as a coil 56 in a housing 58 which screws into the bleed outlet 60 of a filter head 62. The coil outlet 64 can then be connected to a conventional bleed pipe.

FIG. 7 shows the small bore pipe as a coil 66 in a housing 68 which has fittings on either end for connection to conventional fuel piping 70. The housing 68 may thus be inserted into a conventional bleed pipe.

The embodiments of FIGS. 6 and 7 are particularly suitable for installation into a fuel supply system comprising otherwise standard components.

Figure 8:
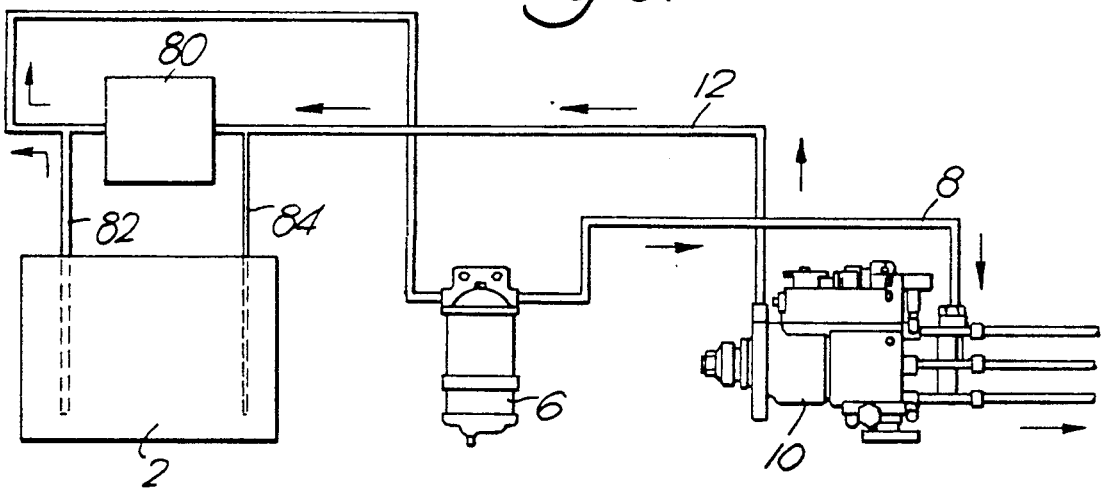
FIG. 8 is a diagram of a diesel fuel low pressure supply system including a small bore pipe connecting the return line to the fuel tank.

FIG. 8 shows a low pressure fuel supply system in which the fuel bleed system of the invention is located near the fuel tank 2. Fuel is returned from a fuel injection pump 10 along a return line 12. The return line 12 passes through an orifice 80 and then is connected to the fuel supply line 82 along which fuel is drawn from the tank 2. A small bore permanent bleed tube 84 connects the return line 12 upstream of the orifice 80 to an inlet of the fuel tank 2.

In operation, fuel is returned from the injection pump 10 along return line 12. The flow is then divided between the orifice 80 for recirculation along the fuel supply line 82 to the fuel filter 6, and the small bore pipe 84 to the fuel tank 2.

For a given pressure drop across an orifice, the flow of fuel through the orifice is principally a function of the fuel density. In a small bore pipe, the flow rate is a function of fuel viscosity. Since fuel density varies only slightly with fuel temperature, and since the fuel pressure downstream of the orifice 80 in the fuel supply line 82 is fairly constant, the pressure in the return line 12 upstream of the orifice 80 is maintained at a fairly constant higher pressure, substantially independent of fuel temperature.

A pressure drop is therefore maintained across the small bore pipe 84 at all times. Since fuel flow along this pipe depends on fuel viscosity, which varies strongly with fuel temperature, fuel flows along the small bore pipe 84 much more rapidly at high fuel temperatures.

At low fuel temperatures fuel is thus principally recirculated via the orifice 80 into the fuel supply line 82. Fuel warmed by the injection pump 10 is therefore recirculated directly to the filter 6, so preventing waxing of the filter. At high temperatures, fuel from the return line 12 flows mainly along the small bore pipe 84 to the fuel tank. Overheating of the injection pump is thus avoided.

The orifice 80 may be replaced by a pressure maintaining or regulating valve, for example a non-return valve, capable of maintaining a suitable fuel pressure in the return line 12 adjacent its junction with the small bore pipe 84.

In the embodiment of FIG. 8, it would be advantageous to include an air separator in the fuel supply system to remove air from the fuel recirculation path.

Figure 9:
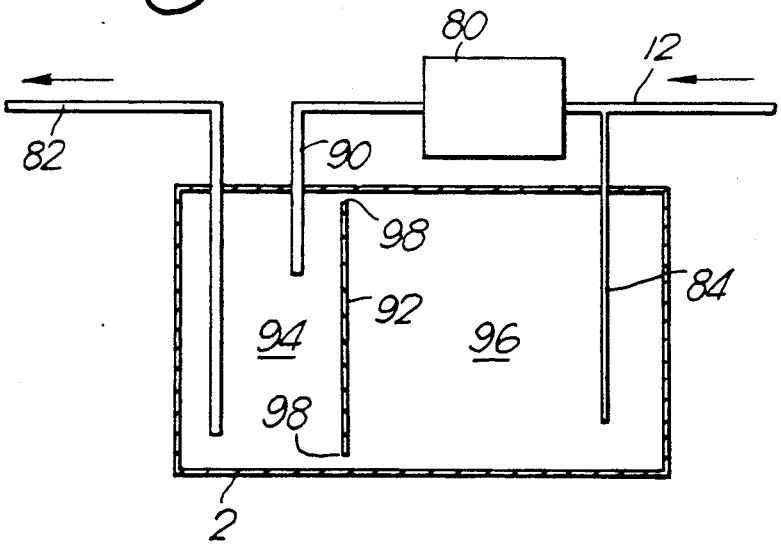
FIG. 9 is a diagram of a fuel tank for a diesel fuel low pressure supply system including two fuel tank portions separated by a baffle.

FIG. 9 shows a further embodiment in which air separation is achieved within the fuel tank. A small bore pipe 84 and an orifice or valve 80 are used as in FIG. 8, but the portion 90 of the return line 12 downstream of the orifice 80 enters the fuel tank 2 rather than connecting to the supply line 82. The fuel tank 2 is provided with a baffle 92 which partially isolates a small portion 94 of the tank 2. The fuel supply line 82 draws fuel from near the bottom of this portion 94 and the return line end portion 90 supplies fuel near the top of this portion 94. The small bore pipe 84 returns fuel to the portion 96 outside the baffle 92. Fuel can flow between the tank portions 94 and 96 around edges 98 of the baffle 92.

When the fuel in the supply system is cold, little recirculated fuel flows along the small bore pipe 84 and so most is recirculated to the smaller tank portion 94. This fuel has been warmed by the injection pump and so warms the fuel in the small tank portion 94 from which the fuel supply line 82 draws fuel. Waxing of the filter is therefore prevented as warmed fuel is recirculated. When the fuel in the return line 12 is warmer, it returns more quickly to the larger fuel tank portion 96 along the small bore pipe 84. The fuel drawn by the fuel supply line 82 is thus warmed much less by the returned fuel and overheating is avoided.

Air separation is achieved in the fuel tank as any air in the fuel returned to the tank simply floats to the top of the fuel in the tank and is not drawn into the fuel supply line 82.

We claim:

1. A low pressure fuel supply system for supplying fuel which tends partially to solidify at low temperatures and whose viscosity increases with decreasing temperature, comprising:

a fuel tank;

a fuel injection pump having an inlet, a high pressure outlet and a fuel return outlet;

a fuel filter;

a fuel supply line extending from said tank, via said filter, to said injection pump inlet;

a fuel recirculation circuit for recirculating fuel warmed by said injection pump along a path extending from said injection pump return outlet, through said filter to said injection pump inlet;

a permanent bleed pipe extending to said fuel tank from a portion of said recirculating circuit between said injection pump return outlet and said filter, said permanent bleed pipe having a first end which forms a junction with said portion of said fuel recirculation circuit and having a second end which opens into said fuel tank, said permanent bleed pipe having flow-resistance-determining dimensions such that said pipe presents increasing resistance to the flow of fuel therein with decreasing fuel temperature so that said permanent bleed pipe carries little flow at low temperatures of the fuel therein, most of the warmed fuel from said injection pump return outlet being directed into said filter, and so that under normal operating conditions when the fuel temperature is higher, said permanent bleed pipe returns more of said warmed fuel from said injection pump return outlet to said fuel tank, thus preventing overheating of the fuel and of said injection pump; and means for maintaining under all operating conditions of said fuel supply system a fuel pressure difference between said ends of said permanent bleed pipe with pressure at said first end always being higher than pressure at said second end.

2. A fuel supply system according to claim 1, including at least one further permanent bleed pipe connected in parallel with said first-mentioned permanent bleed pipe.

3. A fuel supply system according to claim 1, wherein said pressure difference maintaining means includes a non-return valve disposed in said recirculation circuit downstream from said junction of said recirculation circuit with said permanent bleed pipe and upstream from said fuel supply line.

4. A fuel supply system according to claim 1, wherein said pressure difference maintaining means includes an orifice disposed in said recirculation circuit downstream from said junction of said recirculation circuit with said permanent bleed pipe and upstream from said fuel supply line.

5. A fuel supply system according to claim 1, wherein said pressure difference maintaining means includes a low pressure fuel supply pump disposed in said fuel supply line upstream from said recirculation circuit.

6. A fuel supply system according to claim 5, including a non-return valve disposed in said recirculation circuit upstream from said fuel supply line and downstream from said injection pump return outlet.

7. A fuel supply system according to claim 1, wherein said second end of said permanent bleed pipe opens into air in said fuel tank, and wherein said pressure difference maintaining means maintains a fuel pressure greater than atmospheric pressure at said first end of said permanent bleed pipe.

8. A fuel supply system according to claim 1, wherein said recirculation circuit includes means for insuring that said junction with said permanent bleed pipe communicates with said fuel supply line solely on the upstream side of said fuel filter.

9. A low pressure fuel supply system for supplying fuel which tends partially to solidify at low temperatures and whose viscosity increases with decreasing temperature, comprising:

a fuel tank;

a fuel injection pump having an inlet, a high pressure outlet and a fuel return outlet;

a fuel filter;

fuel pipe means including pipes defining a fuel supply line extending from said tank, via said filter, to said injection pump inlet and a fuel recirculation circuit for recirculating fuel warmed by said injection pump along a path extending from said injection pump return outlet, through said filter to said injection pump inlet; and a permanent bleed pipe extending to said fuel tank from a portion of said recirculating circuit between said injection pump return outlet and said filter, said permanent bleed pipe having flow-resistance-determining dimensions such that said pipe presents increasing resistance to the flow of fuel therein with decreasing fuel temperature so that said permanent bleed pipe carries little flow at low temperature of the fuel therein, most of the warmed fuel from said injection pump return outlet being directed into said filter, and so that under normal operating conditions when the fuel temperature is higher, said permanent bleed pipe returns more of said warmed fuel from said injection pump return outlet to said fuel tank, thus preventing overheating of the fuel and of said injection pump, said permanent bleed pipe being substantially smaller in cross-sectional area than any of the pipes of said fuel pipe means.

10. A fuel supply system according to claim 9, wherein said permanent bleed pipe has a first end which is connected to said portion of said fuel recirculation circuit and has a second end which opens into said fuel tank, said fuel supply system including means for maintaining under all operating conditions of said fuel supply system a fuel pressure difference between said ends of said permanent bleed pipe with pressure at said first end always being higher than pressure at said second end.

11. A low pressure fuel supply system for supplying fuel which tends partially to solidify at low temperatures and whose viscosity increases with decreasing temperature, comprising:

a fuel tank;

a fuel injection pump having an inlet, a high pressure outlet and a fuel return outlet;

a fuel filter;

a fuel supply line extending from said tank, via said filter, to said injection pump inlet;

a fuel recirculation circuit for recirculating fuel warmed by said injection pump along a path extending from said injection pump return outlet, through said filter to said injection pump inlet; and a permanent bleed pipe extending to said fuel tank from a portion of said recirculating circuit between said injection pump return outlet and said filter, said permanent bleed pipe having flow-resistance-determining dimensions such that said pipe presents increasing resistance to the flow of fuel therein with decreasing fuel temperature so that said permanent bleed pipe carries little flow at low temperatures of the fuel therein, most of the warmed fuel from said injection pump return outlet being directed into said filter, and so that under normal operating conditions when the fuel temperature is higher, said permanent bleed pipe returns more of said warmed fuel from said injection pump return outlet to said fuel tank, thus preventing overheating of the fuel and of said injection pump, said permanent bleed pipe having a nonuniform cross-section, and including a first bleed pipe portion connected in series with a flow-resistance-determining bleed pipe portion of smaller cross-sectional area than said first bleed pipe portion.

12. A fuel supply system according to claim 11, wherein said permanent bleed pipe has a first end which is connected to said portion of said fuel recirculation circuit and has a second end which opens into said fuel tank, said fuel supply system including means for maintaining under all operating conditions of said fuel supply system a fuel pressure difference between said ends of said permanent bleed pipe with pressure at said first end always being higher than pressure at said second end.

13. A fuel supply system according to claim 12, including at least one further flow-resistance-determining bleed pipe portion connected in parallel with said first-mentioned flow-resistance-determining bleed pipe portion.

14. A low pressure fuel supply system for supplying fuel which tends partially to solidify at low temperatures and whose viscosity increases with decreasing temperature, comprising:

a fuel tank;

a fuel injection pump having an inlet, a high pressure outlet and a fuel return outlet;

a fuel filter;

a fuel supply line extending from said tank, via said filter, to said injection pump inlet;

a fuel recirculation circuit for recirculating fuel warmed by said injection pump along a path extending from said injection pump return outlet, through said filter to said injection pump inlet;

a permanent bleed pipe extending to said fuel tank from a portion of said recirculating circuit between said injection pump return outlet and said filter, said permanent bleed pipe having flow-resistance-determining dimensions such that said pipe presents increasing resistance to the flow of fuel therein with decreasing fuel temperature so that said permanent bleed pipe carries little flow at low temperatures of the fuel therein, most of the warmed fuel from said injection pump return outlet being directed into said filter, and so that under normal operating conditions when the fuel temperature is higher, said permanent bleed pipe returns more of said warmed fuel from said injection pump return outlet to said fuel tank, thus preventing overheating of the fuel and of said injection pump;

said fuel tank including a first fuel tank portion partially separated from a second fuel tank portion by a baffle; and said recirculating circuit including said first fuel tank portion, a fuel return line portion of said recirculating circuit being positioned to return fuel to said first fuel tank portion, said fuel supply line being positioned to draw fuel from said first fuel tank portion and said permanent bleed pipe being positioned to return fuel to said second fuel tank portion.

15. A fuel supply system according to claim 14, in which the recirculating circuit comprises:

a pressure drop maintaining element in said return line portion of said recirculating circuit to maintain a pressure difference in the fuel between the junction of said recirculating circuit with said permanent bleed pipe and an outlet of said return line portion into said first fuel tank portion.

16. A fuel supply system according to claim 14, wherein said permanent bleed pipe has a first end which is connected to said first-mentioned portion of said fuel recirculation circuit and has a second end which opens into said fuel tank, said fuel supply system including means for maintaining under all operating conditions of said fuel supply system a fuel pressure difference between said ends of said permanent bleed pipe with pressure at said first end always being higher than pressure at said second end.

17. A fuel supply system according to claim 16, wherein said pressure difference maintaining means includes a pressure drop maintaining element disposed in said fuel return line portion of said recirculation circuit.

18. A fuel supply system according to claim 17, wherein said pressure drop maintaining element comprises an orifice.

19. A fuel supply system according to claim 17, wherein said pressure drop maintaining element comprises a valve.

20. A low pressure fuel supply system for supplying fuel which tends partially to solidify at low temperatures and whose viscosity increases with decreasing temperature, comprising:

a fuel tank;

a fuel injection pump having an inlet, a high pressure outlet and a fuel return outlet;

a fuel filter;

a fuel supply line extending from said tank, via said filter, to said injection pump inlet;

a fuel recirculation circuit for recirculating fuel warmed by said injection pump along a path extending from said injection pump return outlet, through said filter to said injection pump inlet; and a permanent bleed pipe extending to said fuel tank from a portion of said recirculating circuit between said injection pump return outlet and said filter, said permanent bleed pipe having flow-resistance-determining dimensions such that said pipe presents increasing resistance to the flow of fuel therein with decreasing fuel temperature so that said permanent bleed pipe carries little flow at low temperatures of the fuel therein, most of the warmed fuel from said injection pump return outlet being directed into said filter, and so that under normal operating conditions when the fuel temperature is higher, said permanent bleed pipe returns more of said warmed fuel from said injection pump return outlet to said fuel tank, thus preventing overheating of the fuel and of said injection pump, and including at least one further permanent bleed pipe connected in parallel with said first-mentioned permanent bleed pipe.

* * * * *